US005296185A

United States Patent [19]

Chau et al.

[11] Patent Number: 5,296,185

[45] Date of Patent: Mar. 22, 1994

[54] METHOD FOR SPINNING A POLYBENZAZOLE FIBER

[75] Inventors: Chieh-Chun Chau; Timothy L. Faley; Michael E. Mills, all of Midland, Mich.; Masaru Nakagawa, Ohtsu City, Japan; Timothy J. Rehg; Myrna Serrano, both of Midland, Mich.; Ravi Shanker, Missouri City, Tex.; George J. Quarderer, Jr., Midland, Mich.; Yoshihiko Teramoto, Ohtsu City, Japan

[73] Assignee: The Dow Chemical Company, Midland, Mich.

[21] Appl. No.: 985,079

[22] Filed: Dec. 3, 1992

[51] Int. Cl.[5] ..... D01D 5/04; D01D 10/02; D01D 10/06; D01F 6/26

[52] U.S. Cl. ..... 264/205; 264/210.8; 264/211.12; 264/232; 264/233; 264/234

[58] Field of Search ..... 264/205, 210.8, 211.12, 264/232, 233, 234, 344, 345

[56] References Cited

U.S. PATENT DOCUMENTS

| | | | |
|---|---|---|---|
| 3,584,104 | 6/1971 | Bohrer et al. | 264/205 |
| 3,608,041 | 9/1971 | Santangelo | 264/205 X |
| 4,035,465 | 7/1977 | Brydon | 264/184 X |
| 4,320,081 | 3/1982 | Lammers | 264/184 |
| 4,332,759 | 6/1982 | Ide | 264/205 X |
| 4,374,977 | 2/1983 | Fujiwara et al. | 528/348 |
| 4,374,978 | 2/1983 | Fujiwara et al. | 528/348 |
| 4,419,317 | 12/1983 | Fujiwara et al. | 264/184 |
| 4,440,710 | 4/1984 | Fujiwara et al. | 264/184 |
| 4,466,935 | 8/1984 | Bair et al. | 264/184 |
| 4,702,876 | 10/1987 | Ebregt et al. | 264/184 |
| 5,174,940 | 12/1992 | Kumar et al. | 264/184 |

OTHER PUBLICATIONS

Abstract of Japan 2-84,509, published Mar. 26, 1990.
Abstract of Japan 2-84,510, published Mar. 26, 1990.
Abstract of Japan 2-84,511, published Mar. 26, 1990.
Abstract of Japan 3-104,920, published May 1, 1991.
Abstract of Japan 3-104,921, published May 1, 1991.
Abstract of Japan 4-194,022, published Jul 14, 1992.
U.S. patent application Ser. No. 07/984,828, filed Dec. 3, 1992.
U.S. patent application Ser. No. 07/985,060, filed Dec. 3, 1992.
U.S. patent application Ser. No. 07/985,067, filed Dec. 3, 1992.
U.S. patent application Ser. No. 07/985,068, filed Dec. 3, 1992.
U.S. patent application Ser. No. 07/985,078, filed Dec. 3, 1992.
U.S. patent application Ser. No. 07/985,080, filed Dec. 3, 1992.
MRS, vol. 134, The Materials Science and Engineering of Rigid-Rod Polymers; "*An Integrated Laboratory Process for Preparing Rigid Rod Fibers From the Monomers*" Harvey D. Ledbetter et al. pp. 253-264.
Encyclopedia of Polymer Science and Engineering, Second Edition, vol. 11, "*Polybenzothiazoles and Polybenzoxazoles*", by James F. Wolfe, pp. 601-635 (Undated).
MRS Bulletin, Nov. 16/Dec. 31, 1987 "*High Performance Polymer Fibers*" W. Wade et al. pp. 22-26.
Macromolecules, 1981, vol. 14, "*Synthesis, Spinning & Fiber Mechanical Properties of Poly (p-phenylenebenzobisoxazole)*" by E. Won Choe and Sang Nim Kim; pp. 920-924.

*Primary Examiner*—Leo B. Tentoni
*Attorney, Agent, or Firm*—Charles J. Maurer, III; Margaret Brumm

[57] ABSTRACT

Polybenzazole polymer dopes are spun into fibers at high speed by passing through a spinneret with proper selection of hole geometry, followed by spin-drawing to a spin-draw ratio of at least 20, washing, taking up and drying. The take up speed is at least about 150 meters per minute, and the fibers are spun in at least 10 km lengths without a break.

19 Claims, 6 Drawing Sheets

METHOD FOR SPINNING A POLYBENZAZOLE FIBER

BACKGROUND OF THE INVENTION

The present invention relates to improved processes for spinning fibers that contain polybenzoxazole or polybenzothiazole polymer.

Lyotropic liquid crystalline polybenzoxazole and polybenzothiazole are not thermoplastic. They are typically made into fibers by dry-jet, wet-spinning techniques, in which a dope that contains the polybenzazole polymer and an acid solvent is spun through a spinneret, drawn across an air gap, and coagulated by contact with a fluid that dilutes the solvent and is a non-solvent for the polymer.

It is economically desirable to spin fibers at the highest speed possible, because the spinning equipment is very expensive. It is also desirable to spin individual filaments with as small a diameter as possible (low denier), because fibers that contain a large number of low denier filaments usually have better and more consistent physical properties than fibers that contain a small number of high denier filaments.

Unfortunately, at high speeds and low deniers, the filaments frequently break. It is desirable to develop techniques that will allow spinning of low-denier fibers at high speeds without frequent breakage of the filaments.

SUMMARY OF THE INVENTION

The present invention is a process to spin a fiber from a liquid-crystalline dope that contains poly-phosphoric acid and a lyotropic polybenzazole polymer which is polybenzoxazole, polybenzothiazole or a copolymer thereof, said process comprising the steps of:

(1) spinning the dope through a spinneret that contains:
  (1) two faces and (2) a plurality of holes through which the dope may pass from one face to the other, wherein:
  (a) each hole contains an inlet by which dope enters the hole, a capillary section, and an exit by which dope leaves the hole, and
  (b) the entry to the capillary section and the diameter of the capillary section are selected to spin on average at least about 10 km of finished filament without a filament break whereby a plurality of dope filaments is formed; and
(2) drawing the dope filaments across a draw zone with a spin-draw ratio of at least about 20; and
(3) in any order (a) washing a major part of the polyphosphoric acid from the filaments, (b) drying the washed filaments; and (c) taking up the filaments at a speed of at least 150 meters per minute, whereby filaments that have an average diameter of no more than about 18 μm per filament are formed with on average no more than about one break per 10 km of filament.

The proper selection of hole size and entry angle into the capillary section of the spinneret provide the necessary stability for high speed spinning of thin filaments without line breaks. Selection of capillary size and spin-draw ratio can produce filaments of the desired thinness. Suitable choice of dope flow rates in the capillary and spin-draw ratio provide filaments that are taken up at the desired speed.

BRIEF DESCRIPTION OF DRAWINGS AND FIGURES

FIG. 1 shows a hole in a spinneret (5) having an entry (1), a transition cone (2) with entry angle ($\theta$) a capillary section (9), and an exit FIG. 2 illustrates a fracture in a fiber.

FIG. 3(*a*)–(*d*) shows four different examples of spinneret hole geometry.

FIGS. 4–10 graphically illustrate the shear within a spinneret hole at various line speeds when fiber of a particular thickness is spun (depending upon capillary diameter and spin-draw ratio). For the purpose of those Figures, "μm" is the same as "μm", and SDR stands for spin-draw ratio. The size number next to each spin-draw ratio indicates the capillary diameter.

DETAILED DESCRIPTION OF THE INVENTION

Figure 1:
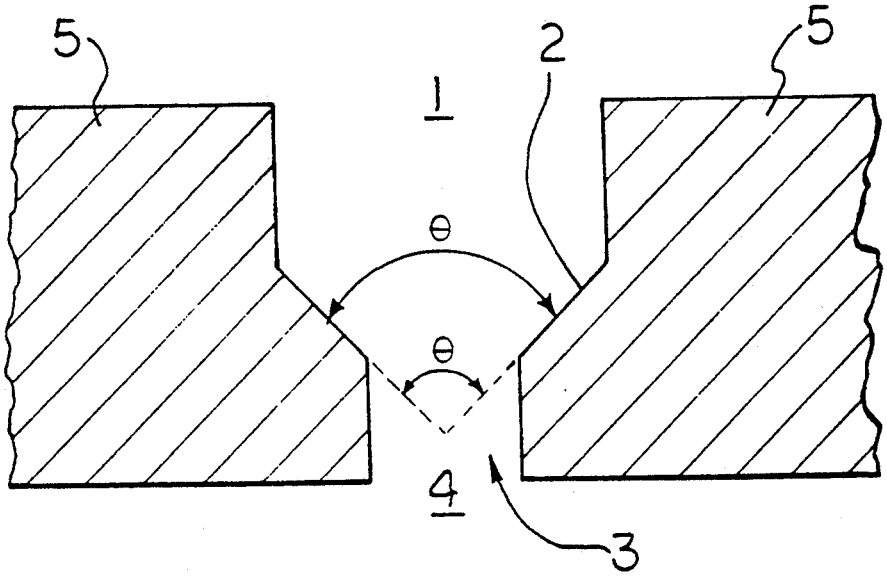

The present invention uses dopes that contain a lyotropic liquid-crystalline polybenzazole polymer, which is polybenzoxazole, polybenzothiazole or a copolymer of those polymers. PBO, PBT and random, sequential and block copolymers of PBO and PBT are described in references such as Wolfe et al., *Liquid Crystalline Polymer Compositions, Process and Products,* U.S. Pat. No. 4,703,103 (Oct. 27, 1987); Wolfe et al., *Liquid Crystalline Polymer Compositions, Process and Products,* U.S. Pat. No. 4,533,692 (Aug. 6, 1985); Wolfe et al., *Liquid Crystalline Poly(2,6-Benzothiazole) Compositions, Process and Products,* U.S. Pat. No. 4,533,724 (Aug. 6, 1985); Wolfe, *Liquid Crystalline Polymer Compositions, Process and Products,* U.S. Pat. No. 4,533,693 (Aug. 6, 1985); Evers, *Thermooxadatively Stable Articulated p-Benzobisoxazole and p-Benzobisthiazole Polymers,* U.S. Pat. No. 4,359,567 (Nov. 16, 1982); Tsai et al., *Method for Making Heterocyclic Block Copolymer,* U.S. Pat. No. 4,578,432 (Mar. 25, 1986); 11 Ency. Poly. Sci. & Eng., *Polybenzothiazoles and Polybenzoxazoles,* 601 (J. Wiley & Sons 1988) and W. W. Adams et al., *The Materials Science and Engineering of Rigid-Rod Polymers* (Materials Research Society 1989).

The polymer may contain AB-mer units, as represented in Formula 1(*a*), and/or AA/BB-mer units, as represented in Formula 1(*b*)

1(a)

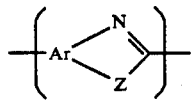

AB

1(b)

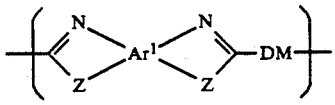

AA/BB wherein:

Each Ar represents an aromatic group selected such that the polybenzazole polymer is a lyotropic liquid-crystalline polymer (i.e. it forms liquid crystalline domains when its concentration in solution exceeds a "critical concentration point"). The aromatic group may be heterocyclic, such as a pyridinylene group, but it is preferably carbocyclic. The aromatic group may be a fused or unfused polycyclic system, but is preferably a single six-membered ring. Size is not critical, but the aromatic group preferably contains no more than about 18 carbon atoms, more preferably no more than about 12 carbon atoms and most preferably no more than about 6 carbon atoms. $Ar^1$ in AA/BB-mer units is preferably a 1,2,4,5-phenylene moiety or an analog thereof. Ar in AB-mer units is preferably a 1,3,4-phenylene moiety or an analog thereof.

Each Z is independently an oxygen or a sulfur atom.

Each DM is independently a bond or a divalent organic moiety selected such that the polybenzazole polymer is a lyotropic liquid crystalline polymer. The divalent organic moiety is preferably an aromatic group (Ar) as previously described. It is most Preferably a 1,4-phenylene moiety or an analog thereof.

The nitrogen atom and the Z moiety in each azole ring are bonded to adjacent carbon atoms in the aromatic group, such that a five-membered azole ring fused with the aromatic group is formed.

The azole rings in AA/BB-mer units may be in cis- or transposition with respect to each other, as illustrated in 11 Ency. Poly. Sci. & Eng., supra, at 602, which is incorporated herein by reference.

The polymer preferably consists essentially of either AB-PBZ mer units or AA/BB-PBZ mer units, and more preferably consists essentially of AA/BB-PBZ mer units. Azole rings within the polymer are preferably oxazole rings (Z=0).

Preferred mer units are illustrated in Formulae 2 (*a*)-(*h*). The polymer more preferably consists essentially of mer units selected from those illustrated in 2(*a*)-(*h*), and most preferably consists essentially of a number of identical units selected from those illustrated in 2(*a*)-(*d*).

2

(a)

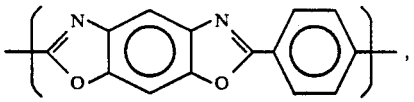

(b)

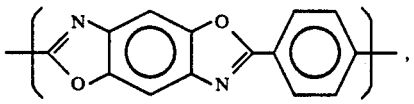

(c)

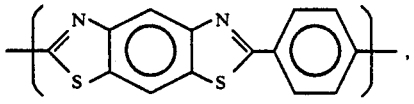

(d)

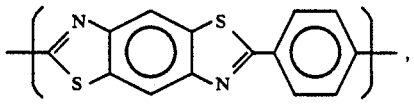

(e)

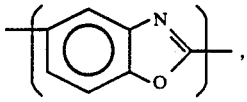

-continued (f)

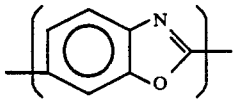

(g)

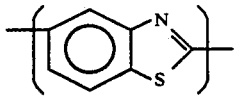

, and (h)

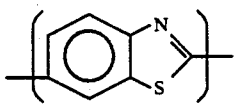

Each polymer preferably contains on average at least about 25 repeating units, more preferably at least about 50 repeating units and most preferably at least about 100 repeating units. The intrinsic viscosity of rigid AA/BB-PBZ polymers in methanesulfonic acid at 25° C. is preferably at least about 10 dL/g, more preferably at least about 15 dL/g and most preferably at least about 20 dL/g. For some purposes, an intrinsic viscosity of at least about 25 dL/g or 30 dL/g may be best. Intrinsic viscosity of 60 dL/g or higher is possible, but the intrinsic viscosity is preferably no more than about 50 dL/g. The intrinsic viscosity of semi-rigid AB-PBZ polymers is preferably at least about 5 dL/g, more preferably at least about 10 dL/g and most preferably at least about 15 dL/g.

The polymer or copolymer is dissolved in poly-phosphoric acid to form a solution or dope. The poly-phosphoric acid preferably contains at least about 80 weight percent $P_2O_5$, and more preferably at least about 83 weight percent. It preferably contains at most about 90 weight percent $P_2O_5$, and more preferably at most about 88 weight percent. It most preferably contains between about 87 and 88 weight percent $P_2O_5$.

The dope should contain a high enough concentration of polymer for the dope to contain liquid-crystalline domains. The concentration of the polymer is preferably at least about 7 weight percent, more preferably at least about 10 weight percent and most preferably at least about 14 weight percent. The maximum concentration is limited primarily by practical factors, such as polymer solubility and dope viscosity. The concentration of polymer is seldom more than 30 weight percent, and usually no more than about 20 weight percent.

Suitable polymers or copolymers and dopes can be synthesized by known procedures, such as those described in Wolfe et al., U.S. Pat. No. 4,533,693 (Aug. 6, 1985); Sybert et al., U.S. Pat. No. 4,772,678 (Sep. 20, 1988); Harris, U.S. Pat. No. 4,847,350 (Jul. 11, 1989); Gregory, U.S. Pat. No. 5,089,591 (Feb. 18, 1992); and Ledbetter et al., "An Integrated Laboratory Process for Preparing Rigid Rod Fibers from the Monomers, "*The Materials Science and Engineering of Rigid-Rod Polymers* at 253-64 (Materials Res. Soc. 1989). In summary, suitable monomers (AA-monomers and BB-monomers or AB--monomers) are reacted in a solution of nonoxidizing and dehydrating acid under nonoxidizing atmosphere with vigorous mixing and high shear at a temperature that is increased in step-wise or ramped fashion from no more than about 120° C. to at least about 190° C. Examples of suitable AA-monomers include terephthalic acid and analogs thereof. Examples of suitable BB-monomers include 4,6-diaminoresorcinol, 2,5-diaminohydroquinone, 2,5-diamino-1,4-dithiobenzene and analogs thereof, typically stored as acid salts. Examples of suitable AB-monomers include 3-amino-4-hydroxybenzoic acid, 3-hydroxy-4-aminobenzoic acid, 3-amino-4-thiobenzoic acid, 3-thio-4-aminobenzoic acid and analogs thereof, typically stored as acid salts.

In order for the most efficient spinning, the dope should preferably be very homogeneous and free of solid particulates. Particulates can be eliminated by known methods, such as (but not limited to) filtering particles using screens and/or shear filtration media like silica sand, metal filings or particulates, glass beads, sintered ceramics or sintered metal plates or shaped structures. Likewise, the dope can be further homogenized using known equipment such as single- and multiple-screw extruders, static mixers and other mixing devices.

The dope is spun through a spinneret. Referring to FIG. 1, the spinneret contains a plate or thimble shaped structure (5), which contains a plurality of holes that go from one face of the spinneret to the other. The number of holes in the spinneret and their arrangement is not critical to the invention, but it is desirable to maximize the number of holes for economic reasons. The spinneret may contain as many as 100 or 1000 or more, and they may be arranged in circles or in grids or in any other desired arrangement. The spinneret may be constructed out of ordinary materials that will not be degraded by the dope, such as stainless steel.

Referring to FIG. 1, each hole contains:

(a) an inlet (1)

(b) optionally, a transition cone(2) where the hole narrows by an angle ($\theta$) before entry into a capillary section, (c) a capillary section (9), which is the thinnest (smallest-diameter) section of the hole where the walls are about parallel, and (d) an exit (4).

The inlet may optionally have a counterbore, which may optionally be concave upward or concave downward or a fixed angle.

The capillary section is usually immediately adjacent to the exit from the hole, and usually has about the same diameter as the exit from the hole. The length of the capillary section is not critical to the present invention. It is preferably at least about 0.1 times the diameter of the capillary, more preferably at least about 0.5 times the diameter of the capillary, and most preferably at least about 0.8 times the diameter of the capillary. The length of the capillary is preferably no more than about 10 times the diameter of the capillary, more preferably no more than about 5 times the diameter of the capillary and most preferably no more than about 3.5 times the diameter of the capillary. The diameter of the hole may be about uniform all the way through, in which case the capillary section extends throughout the entire hole and there is no transition cone. However, the hole is preferably broader at the inlet, and becomes narrower through a transition cone within the spinneret to form a capillary section that leads to the exit.

The entry angle into the capillary is the encompassing angle $\theta$ between the walls in the transition cone immediately before the dope enters the capillary section, as shown in FIG. 1. The transition cone may contain several different angles, but the entry angle just prior to the capillary is the critical angle for the present invention.

Dope passes into the inlet, through the hole (including the capillary section) and out of the exit into a draw zone. The size and geometry of the hole are preferably selected to maximize the stability of the dope flow through the hole, as described hereinafter.

Thin (low-denier) filaments can be spun at high speeds either by using a relatively small capillary section with relatively low spin-draw ratio or by using a relatively large capillary section at relatively high spin-draw ratios. There is no hard line between a high draw-large hole process and a low draw-small hole process. Both lie on a continuum, and the line may be selected for convenience. In a low draw-small hole process, the capillary section and the exit preferably have an average diameter of no more than about 0.5 mm, more preferably no more than about 0.4 mm, and most preferably no more than about 0.35 mm. The exit is usually at least about 0.05 mm in diameter, and preferably at least about 0.08 mm. In a high draw-large hole process, the capillary and exit are usually at least about 0.5 mm in diameter, preferably at least about 1 mm and more preferably at least about 1.5 mm. They are preferably no more than about 5 mm in diameter and more preferably no more than about 3.5 mm in diameter.

Dope that passes through the hole is subjected to shear. The maximum shear ordinarily occurs in the capillary section. The capillary shear rate ($\gamma$) (in sec.$^{-1}$) can be conveniently estimated by the Formula:

$$Y = 8v_c/D_c$$

wherein $v_c$ is the average velocity of dope through the capillary section (in meters/sec.) and $D_c$ is the diameter of the capillary section (in meters). The capillary velocity ($v_c$) is conveniently calculated by mass or volumetric flow rates. As the capillary section becomes smaller and/or the velocity of the dope through the capillary increases, the shear on the dope increases as well. As the shear rate increases, the geometry of the hole becomes more important.

For a dope that contains about 14 weight percent polymer in polyphosphoric acid at about 160° C.–180° C., the entry angle ($\theta$) may be about 180° or less as long as the shear rate on the dope in the capillary is less than about 500 see.$^{-1}$. When the shear rate reaches about 1500 sec.$^{-1}$, the angle must be no more than about 90°. When the shear rate reaches about 2500 sec.$^{-1}$, the angle must be no more than about 60°. When the shear rate reaches about 3500 sec.$^{31\ 1}$, the angle must be no more than about 30°. When the shear rate reaches about 5000 sec.$^{-1}$, the angle must be no more than about 20°. If the entry angle is greater, then the line stability usually decreases, and the line is more likely to break. FIGS. 4–10 relate shear rate within the capillary section to the width of the capillary section, the spin-draw ratio and the speed of the fiber line for different fiber thickness.

When the dope is more viscous than the dope described above, the angle may need to be more acute than described above, and when the dope is less viscous, the angle may be more obtuse. Viscosity can be affected by many different factors, such as temperature, shear rate, molecular weight of the polyphosphoric acid and the polybenzazole polymer, and concentration of the polybenzazole polymer. For instance, when the dope temperature is increased above 180° C., it may be possible to operate at shear rates above those permitted in the foregoing paragraph for each specified entry angle.

Figure 2:
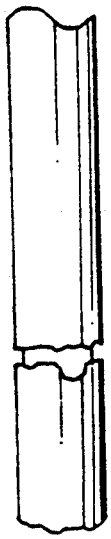
Figure 3A:
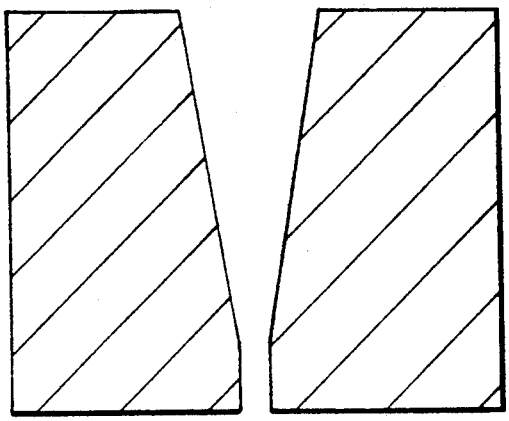
Figure 3B:
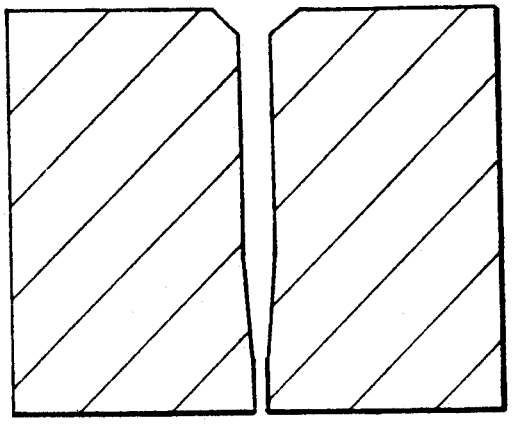
Figure 3C:
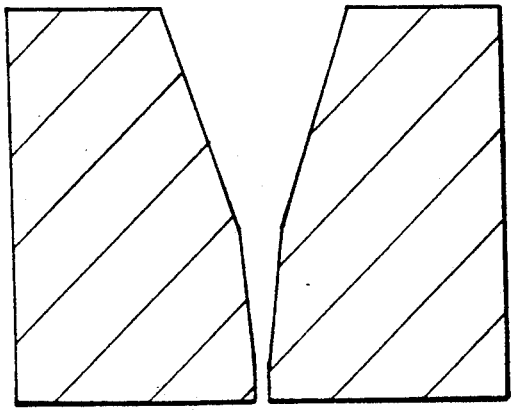
Figure 3D:
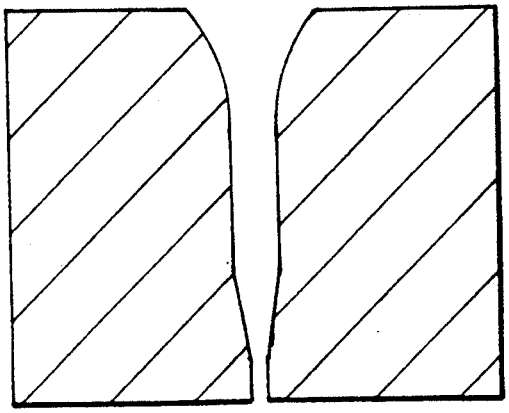
Figure 4:
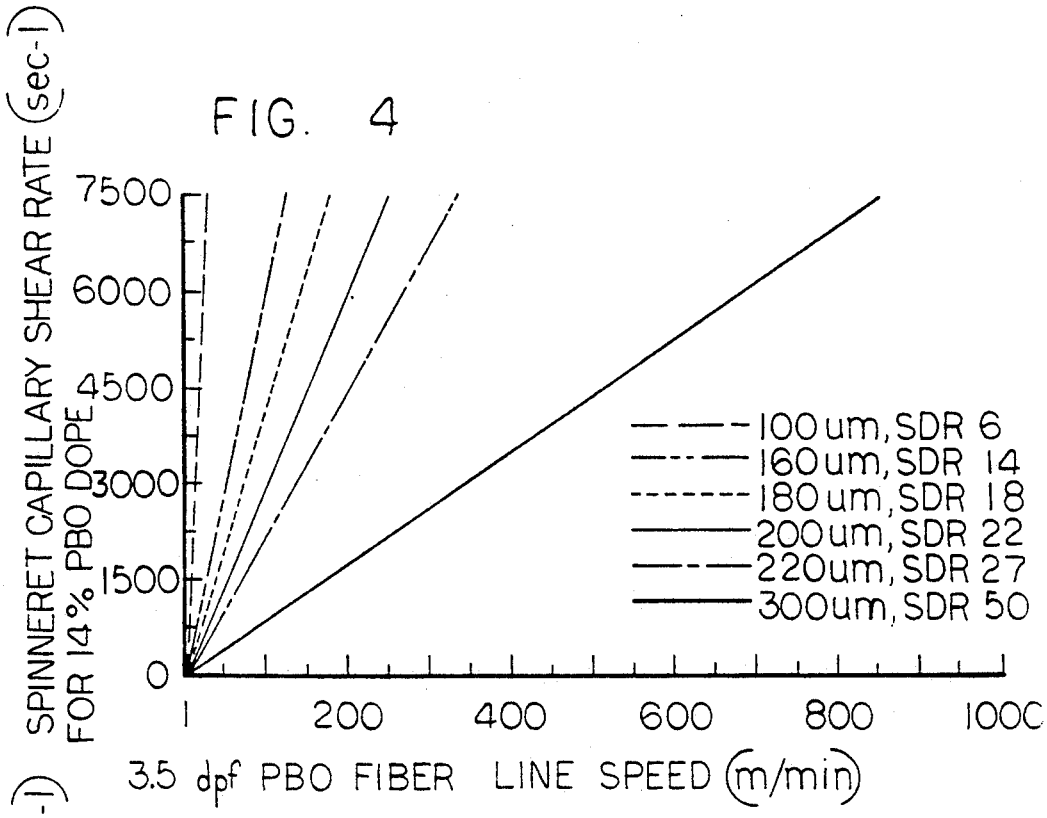
Figure 5:
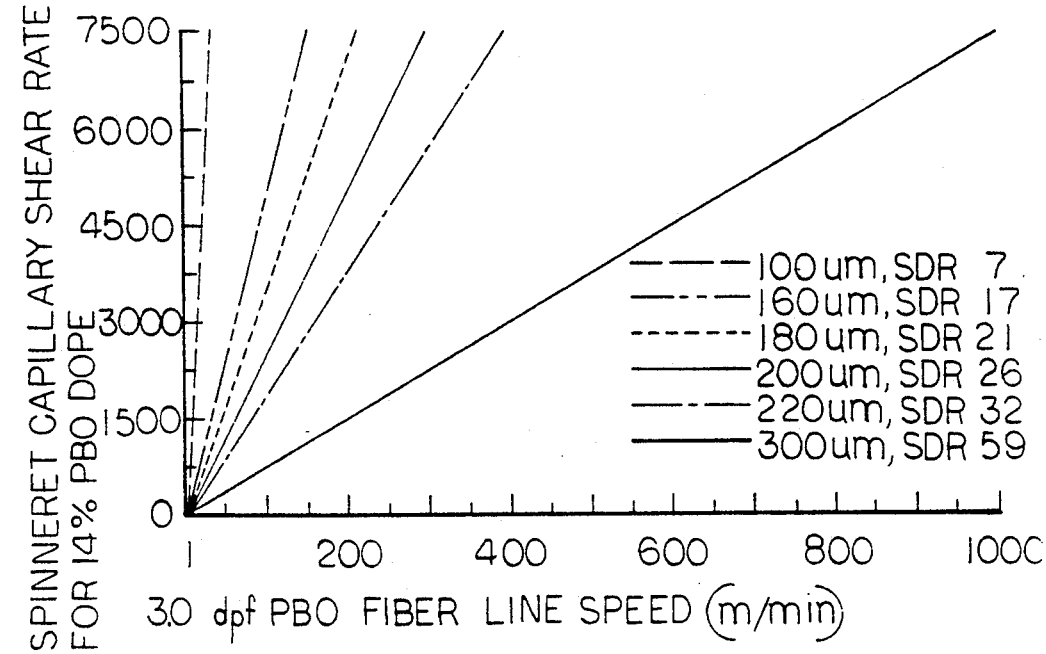
Figure 6:
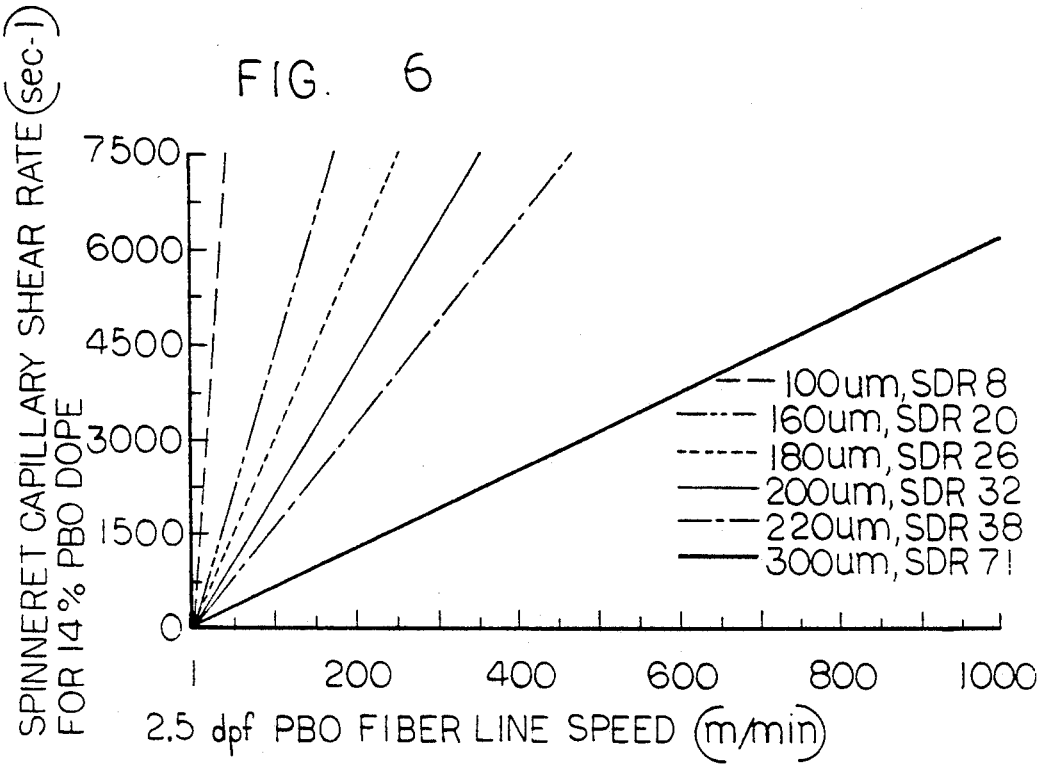
Figure 7:
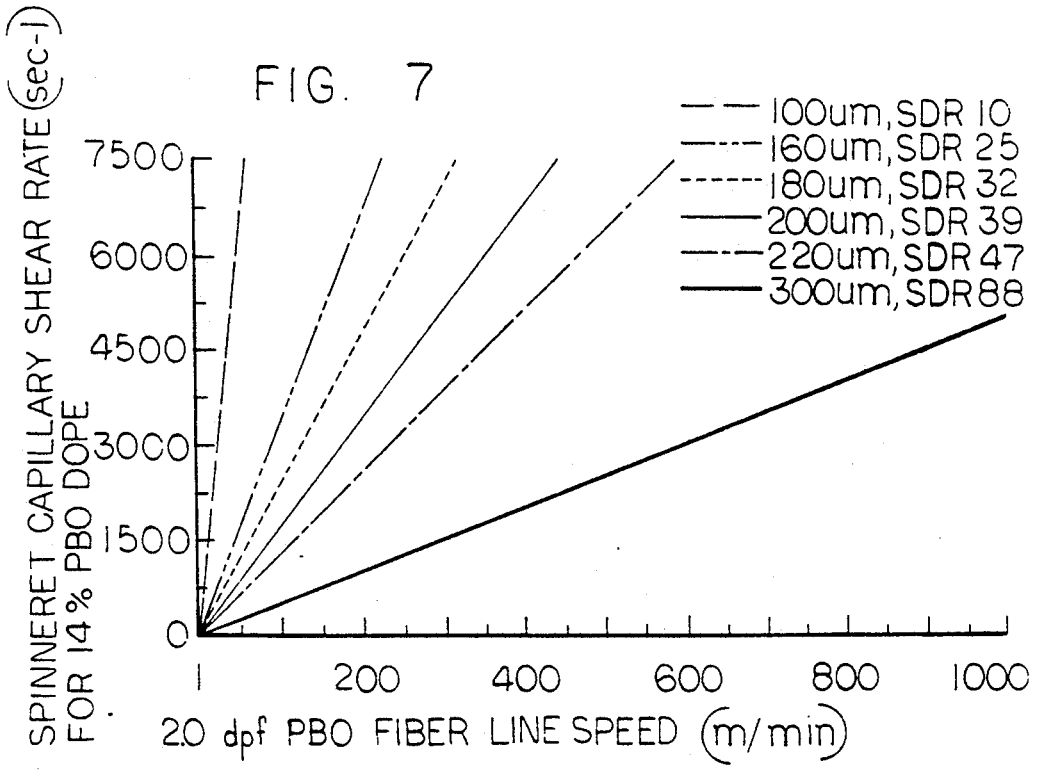
Figure 8:
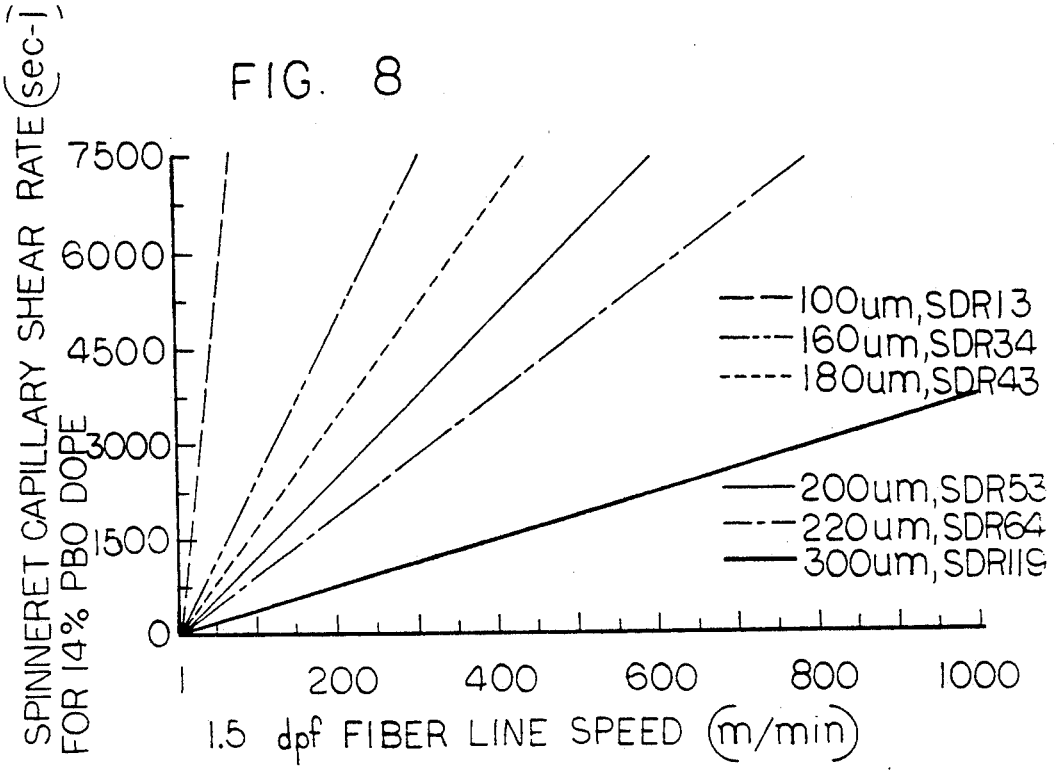
Figure 9:
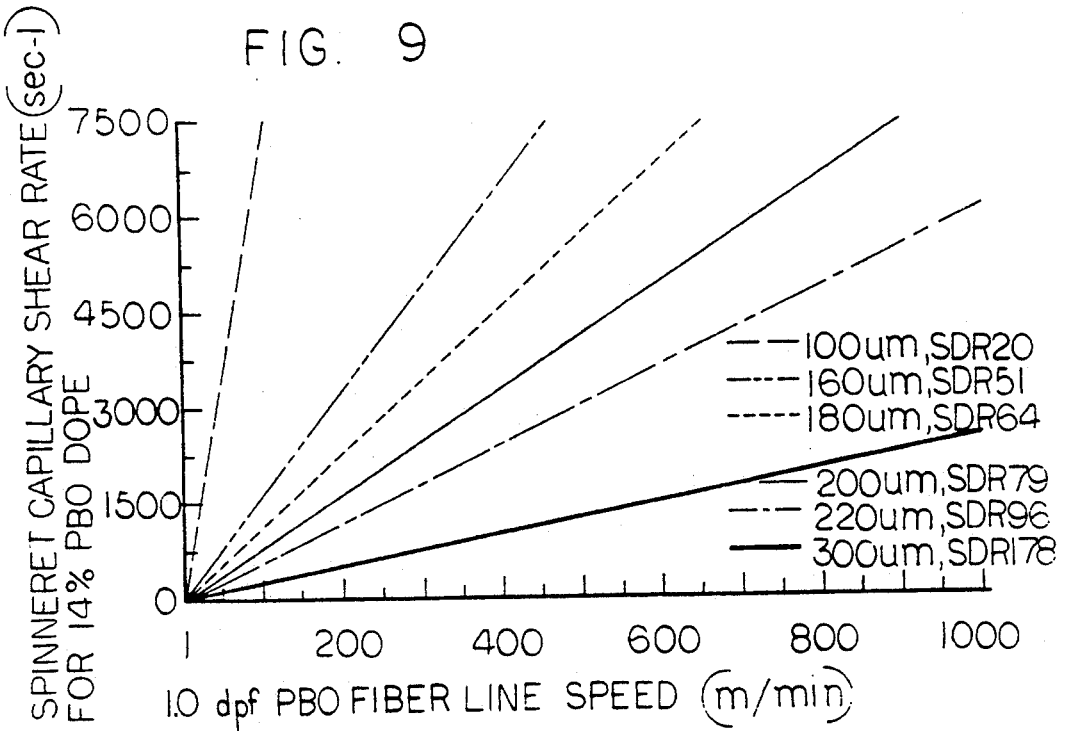
Figure 10:
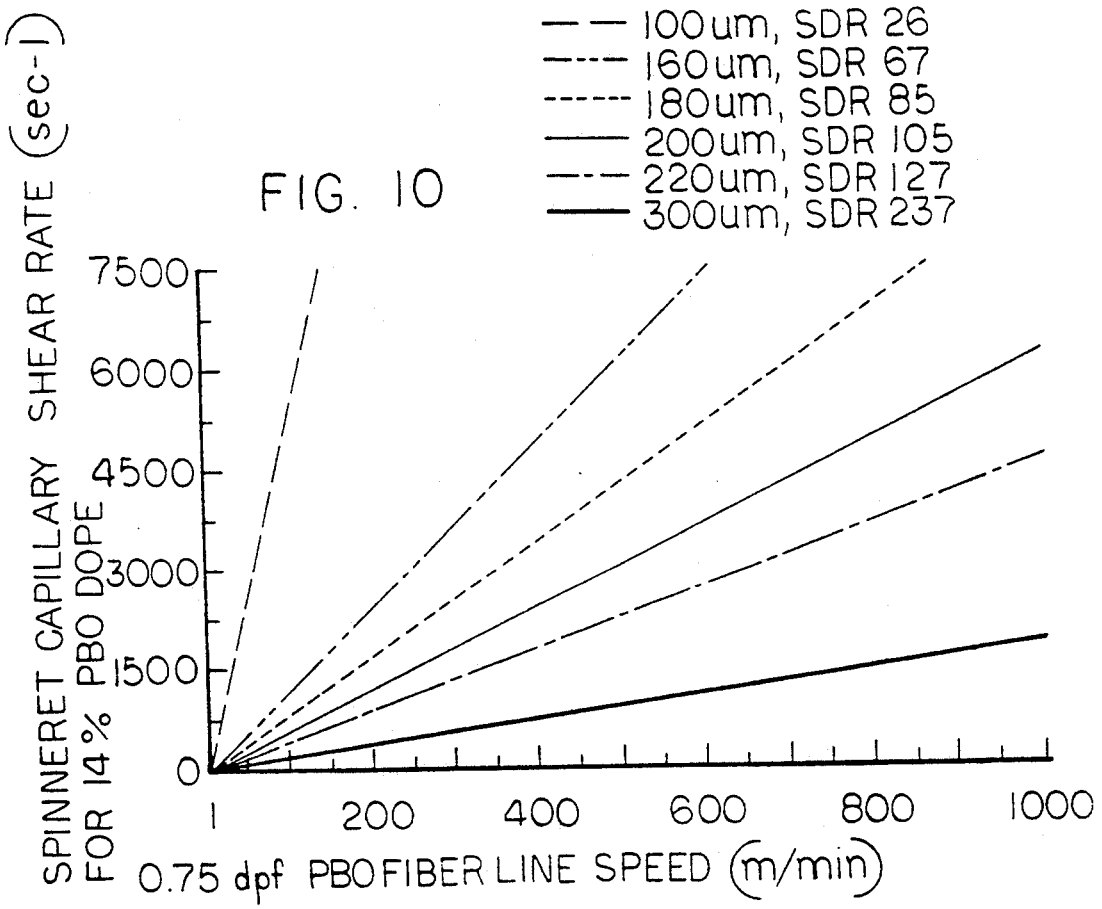

One theory, which we present without intending to be bound thereby, states that the previously-described hole geometry may be necessary for the following reasons. Generally, the spinning dope at typical fiber processing conditions has a high viscosity. For example, the zero shear viscosity of 14% polyphosphoric acid solution of cis-polybenzoxazole (30 dL/g I.V.) at 150° C. reaches as much as 1,000,000 poise. At spinning conditions the viscosity drops due to shear rate effects, but it still has unusually high viscosity for wet spinning. We theorize that for this reason the spinneret design needs to be similar to designs used in melt spinning. Moreover, we theorize that a spinning dope of this general composition has very unique flow behavior because of its liquid crystalline composition and highly elastic character. We theorize that the spinning dope forms domains with a diameter of about 100 microns or less. Even when the dope is deformed by shear, the domain structure does not disappear easily. We theorize that the maximum spin draw ratio in spinning is mainly determined by the extensibility of this domain structure. When the spinneret holes do not meet the criteria set out in this application, the domains at the surface of a filament become significantly more extended than domains at the center of a filament. The domains at the surface can not extend as far as center domains without breaking and so the surface domains limit the spin draw ratio of whole filament. For this reason the fracture end of a filament shown in FIG. 2 is often observed at the break end of yarn.

Examples of desirable spinneret holes are shown in FIG. 3(*a*)-(*d*). The hole may contain a single transition cone, as shown in FIG. 3(*a*) and (*b*) or multiple cones, as shown in FIG. 3(*c*), but only the last cone before the capillary section is described as the entry angle to the capillary.

The dopes typically exhibit a softening temperature similar to a thermoplastic material. They are preferably extruded at a temperature that is above the softening temperature, but below the decomposition temperature of the dope. The spinning temperature is preferably selected so that the viscosity of the dope (in state of shear flow) will be between 50 and 1000 poise. For most dopes, the temperature is preferably at least about 120° C., more preferably at least about 140° C., and preferably at most about 220° C., and more preferably at most about 200° C. For example, in the case of a dope that contains 14% cis-PBO with an intrinsic viscosity of 30 dL/g, the spinning temperature is preferably about 130°-190° C. and more preferably 160°-180° C.

Dope exiting the spinneret enters a gap between the spinneret and the coagulation zone. The gap is typically called an "air gap" although it need not contain air. The gap may contain any fluid that does not induce coagulation or react adversely with the dope, such as air, nitrogen, argon, helium br carbon dioxide. The air gap contains a draw zone where the dope is drawn to a spin-draw ratio of at least about 20, preferably at least about 40, more preferably at least about 50 and most preferably at least about 60. The spin-draw ratio is defined in this application as the ratio between the take-up velocity of the filaments and the capillary velocity ($v_c$) of the dope. The draw should be sufficient to provide a fiber having the desired diameter per filament, as described hereinafter. To spin low diameter filaments using large holes, very high spin-draw ratios (such as 75, 100, 150 or 200 or more) may be desirable. The temperature in the air gap is preferably at least about 10° C. and more preferably at least about 50° C. It is preferably no more than about 200° C. and most preferably no more than about 170° C. The length of the air gap is usually at least about 5 cm and at most about 100 cm, although it may be longer or shorter if desired.

When the filament leaves the draw zone, it should be moving at a rate of at least about 150 meter/min. It is preferably moving at at least about 200 meter/min, more preferably at least about 400 meter/min and most preferably at least about 600 meter/min. Speeds of about 1000 meter/min. or more can be reached. The filament is washed to remove residual acid and taken up as yarn or fiber. It is usually washed by contact with a fluid that dilutes the solvent and is a non-solvent for the polybenzazole. The fluid may be a gas, such as steam, but it is preferably a liquid and more preferably an aqueous liquid. The washing may occur in a single stage or in multiple stages. The stages may occur before or after the fiber is taken up, or some may come before and some after.

The bath may be in many different forms, such as the baths described in Japanese Laid Open Pat. No. 63-12710; Japanese Laid Open Pat. No. 51-35716; and Japanese Published Pat. No. 44-22204, which are incorporated herein by reference. Also, the fiber may be sprayed as it passes between two rollers, for instance as described in Guertin, U.S. Pat. No. 5,034,250 (Jul. 23, 1991), which is incorporated herein by reference. The washed fiber preferably contains no more than about 2 weight percent residual acid, and more preferably no more than about 0.5 weight percent.

The washed fiber is dried by known methods, such as by passing the fiber through an oven or by passing the fiber over heated rollers or by subjecting it to reduced pressure. The drying is preferably carried out at no more than about 300° C., in order to avoid damage to the fiber. Examples of preferred washing and drying processes are described in Chau et al., U.S. Ser. No. 07/929,272 (filed Aug. 13, 1992), which is incorporated herein by reference.

The fiber may be heat-treated to increase tensile modulus if desired. For instance, it is well known in the art to heat-treat polybenzazole fibers by passing them through a tubular furnace under tension. See, e.g., Chenevey, U.S. Pat. No. 4,554,119 (Nov. 19, 1985), which is incorporated herein by reference. In a preferred heat-treating process, the heat-treating medium is steam that moves cocurrent with the fiber. A finish may also be applied to the fiber if desired.

The resulting fiber has an average filament diameter of no more than about 18 μm. The fiber diameter is preferably no more than about 17 μm, more preferably no more than about 15 μm, and most preferably no more than about 12 μm. Its denier is preferably no more than about 3.5 dpf(denier-per-filament), highly preferably no more than about 3.2 dpf, more preferably no more than about 2.5 dpf, and most preferably no more than about 1.6 dpf. Denier, a common measure of fiber thickness, is the weight in grams of 9000 meters of fiber. Diameters of 10 μm or 8 μm or less can be reached. The minimum filament diameter and denier is limited by practical considerations. Each filament usually has an average diameter of at least about 3 μm and an average denier of at least about 0.1 dpf.

The present invention can be reduced to practice in many different embodiments. In one preferred embodiment, the entry angle to the capillary is no more than about 30°, the hole size is between about 0.1 mm and 0.5 mm and the spin-draw ratio is at least about 20, as previously described.

The present invention makes it possible to spin the desired fibers with relatively high line stability. The line can preferably spin at least about 10 km at each spinning position without a filament break, more preferably at least about 100 km, and most preferably at least about 1000 km. The average tensile strength of the fiber is preferably at least about 1 GPa, more preferably at least about 2.75 GPa, more highly preferably at least about 4.10 GPa, and most preferably at least about 5.50 GPa. The average tensile modulus of the fiber is preferably at least 260 GPa and more preferably at least 310 GPa.

ILLUSTRATIVE EXAMPLES

The following examples are for illustrative purposes only. They should not be taken as limiting the scope of either the specification or the claims. Unless stated otherwise, all parts and percentages are by weight.

In some examples, yarn-break frequency in spinning is counted with two or more spinning machines, and is converted into the number of breaks per one spinning position for a given number of hours.

The intrinsic viscosity of a polybenzazole is measured at 30° C. using methanesulfonic acid as the solvent.

EXAMPLE 1

SPINNING OF PBO DOPE

A polymer solution which consists of 14.7wt% of cis-polybenzoxazole (21 I.V.) and polyphosphoric acid (84.3 weight percent $P_2O_5$) is mixed and degassed with a twin screw extruder at 170° C. The dope is extruded from the spinneret having 166 holes. The geometry and capillary diameter of the holes is described in Table 1. The throughput per hole and the hole shape is shown in Table 1. The spin draw ratio is shown in Table 1. The extruded yarn is introduced into a coagulation bath which has a spinning funnel installed 55 em below from the spinneret and in which coagulation water is maintained at about 22° C. The fiber is washed to remove residual acid and moisture in the fiber is removed by contacting on a heating roller. A spin finish is applied and the fiber is taken up on a winder. The take-up speed of spinning is measured. The results are shown in Table 1.

TABLE 1

| | Sample | |
|---|---|---|
| | A | B |
| Dope Through-put (g/min) | 40 | 62 |
| Capillary diameter ($D_c$) (mm) | 0.22 | 0.25 |
| Hole Shape illustrated in FIG. | 3(a) | 3(b) |
| Entry Angle (°) | 20 | 20 |
| Calculated shear rate (y) (sec.$^{-1}$) | 1946 | 2051 |
| Take-up speed (m/min.) | 200 | 310 |
| Spin-Draw Ratio | 63 | 81 |
| Filament Breaks (Breaks per hour) | 0.02 | 0.05 |
| Denier per filament | 1.5 | 1.5 |

EXAMPLE 2

SPINNING OF PBO DOPE

A dope that contains 14 weight percent cis-PBO dissolved in polyphosphoric acid is homogenized and filtered using metal screens and a sand pack shear-filtration medium. The dope is spun through a 10 hole spinneret with a throughput of 2.4 g/min. The temperature of the spin block and spinneret is 165° C. The hole size is 0.20 mm and the hole geometry is as illustrated in FIG. 3(*b*) with a convergence angle ($\theta$) of 20°. The shear rate in the capillary section is calculated at about 2585 sec.$^{-1}$. The spin-draw ratio of the fiber is 52. The fiber is washed, taken up at a speed of 200 re/min., washed further and dried. The fiber has an average diameter of 11.5 μm. The spinning is continuous for 60 minutes (12,000 meters) without a filament break.

What is claimed is:

1. A process to spin a fiber from a liquid-crystalline dope that contains a solvent polyphosphoric acid and a lyotropic polybenzazole polymer which is polybenzoxazole, polybenzothiazole or a copolymer thereof, said process comprising the steps of:

(1) spinning the dope through a spinneret that contains:

(1) two faces and (2) a plurality of holes through which the dope may pass from one face to the other, wherein:

(a) each hole contains an inlet by which dope enters the hole, a capillary section, and an exit by which dope leaves the hole, and (b) the entry to the capillary section and the diameter of the capillary section are selected to spin on average at least about 10 km of finished filament, with no more than about one break per 10 km of filament spun;

whereby a plurality of dope filaments is formed; and (2) drawing the dope filaments across a draw zone with a spin-draw ratio of at least about 20; and (3) in any order (a) washing a major part of the polyphosphoric acid from the filaments, (b) drying the washed filaments and (c) taking up the filaments at a speed of at least 150 meters per minute whereby filaments that have an average diameter of no more than about 18 μm per filament are formed with on average no more than about one break per 10 km of filament.

2. The process of claim 1 wherein the inlet to each hole is larger than the exit, and the hole contains at least one transition cone, in which the diameter of the hole decreases, prior to the capillary section.

3. The process of claim 2 wherein capillary shear rate is less than about 1500 sec.$^{-1}$.

4. The process of claim 3 wherein the transition cone immediately prior to the capillary section has an entry angle of no more than about 90°.

5. The process of claim 2 wherein the transition cone immediately prior to the capillary section has an entry angle of no more than about 60°.

6. The process of claim 5 wherein the shear rate in the capillary section is between 500 sec.$^{-1}$ and 3500 sec.$^{-1}$.

7. The process of claim 6 wherein the spinning temperature is about 160°-1800° C.

8. The process of claim 2 wherein the transition cone immediately prior to the capillary section has an entry angle of no more than about 30°.

9. The process of claim 8 wherein the shear rate in the capillary section is about 500 sec.$^{-1}$ and about 5000 sec.$^{-1}$.

10. The process of claim 9 wherein the spinning temperature is about 160°-180° C.

11. The process of claim 2 wherein the transition cone immediately prior to the capillary section has an entry angle of no more than about 20°.

12. The process of claim 11 wherein the shear rate in the capillary section is greater than about 5000 see.$^{-1}$.

13. The process of claim 12 wherein the spinning temperature is about 160°-1800° C.

14. The process of claim 2 wherein the spinning temperature is above 180° C.

15. The process of claim 1 wherein the spin-draw ratio is at least about 40.

16. The process of claim 1 wherein the spin-draw ratio is at least about 75.

17. The process of claim 1 wherein the filaments are taken up at a rate of at least about 200 meter/min.

18. The process of claim 1 wherein the filaments are taken up at a rate of at least about 400 meter/min.

19. The process of claim 1 wherein the average diameter per filament is at least about 3 μm and most about 12 μm.

* * * * *